US009546549B2

(12) United States Patent
Hauzer

(10) Patent No.: US 9,546,549 B2
(45) Date of Patent: Jan. 17, 2017

(54) VENTILATION SYSTEM FOR TUNNEL SECTION OR COVERED ROAD

(76) Inventor: Antonius Theodorus Cecilianus Hauzer, Zaltbommel (NL)

( * ) Notice: Subject to any disclaimer, the term of this patent is extended or adjusted under 35 U.S.C. 154(b) by 802 days.

(21) Appl. No.: 12/096,645

(22) PCT Filed: Dec. 8, 2006

(86) PCT No.: PCT/NL2006/050309
§ 371 (c)(1),
(2), (4) Date: Jul. 8, 2008

(87) PCT Pub. No.: WO2007/067056
PCT Pub. Date: Jun. 14, 2007

(65) Prior Publication Data

US 2008/0293350 A1 Nov. 27, 2008

(30) Foreign Application Priority Data

Dec. 9, 2005 (NL) ..... 1030639

(51) Int. Cl.
*F24F 9/00* (2006.01)
*E21F 1/00* (2006.01)

(52) U.S. Cl.
CPC ..... *E21F 1/003* (2013.01)

(58) Field of Classification Search
CPC ..... F24F 7/06; F24F 3/161; F24F 2009/002; F24F 9/00; F24F 3/1607; F24F 2009/007; F25D 23/023; Y10S 55/29; E21F 1/08; E21F 1/14; E21F 1/10; E21F 1/003
USPC ..... 454/167, 188–190, 166, 187
See application file for complete search history.

(56) References Cited

U.S. PATENT DOCUMENTS

| | | | | |
|---|---|---|---|---|
| 983,877 | A * | 2/1911 | Cummings | 454/190 |
| 3,143,952 | A * | 8/1964 | Simons | 454/190 |
| 4,037,526 | A | 7/1977 | Jaekle | |
| 5,031,515 | A * | 7/1991 | Niemela et al. | 454/236 |
| 5,086,692 | A * | 2/1992 | Welch et al. | 454/187 |
| 5,236,476 | A * | 8/1993 | Klick | 96/399 |
| 5,704,833 | A * | 1/1998 | Reix | F24F 3/161 454/187 |

(Continued)

FOREIGN PATENT DOCUMENTS

| | | | |
|---|---|---|---|
| DE | 1 279 055 | B | 10/1968 |
| EP | 240713 | A1 * | 10/1987 |

(Continued)

OTHER PUBLICATIONS

Ciocanea, Adrian, On Using Double Air Curtains for Ventilation of Urban Road Tunnels, 2009, Conference on Modeling Fluid Flow, pp. 525-532.*

*Primary Examiner* — Craig Schneider
*Assistant Examiner* — Angelisa L Hicks
(74) *Attorney, Agent, or Firm* — Young & Thompson

(57) ABSTRACT

Ventilation system (1) of a tunnel or covered road section (2), in which the tunnel (2) comprises at least a first tunnel tube or carriageway (11; 11, 12) with a first entrance (3; 3, 5) and a first exit (4; 4, 6) for traffic (T1; T1, T2) through the at least first tunnel tube (11), and the ventilation system (1) is equipped for: —the production of a blind flow or recirculation flow of air inside the at least first tunnel tube during use, and —the controlled discharge of air from the blind flow or recirculation flow at the entrance and/or exit of the at least first tunnel tube.

20 Claims, 4 Drawing Sheets

(56) References Cited

U.S. PATENT DOCUMENTS

| | | | | |
|---|---|---|---|---|
| 6,186,888 | B1 * | 2/2001 | Ohashi | 454/167 |
| 6,251,006 | B1 * | 6/2001 | Laborde et al. | 454/190 |
| 2003/0091394 | A1 | 5/2003 | Ide | |
| 2004/0194371 | A1 * | 10/2004 | Kinnis | 47/17 |

FOREIGN PATENT DOCUMENTS

| | | | |
|---|---|---|---|
| EP | 1783323 | A1 * | 5/2007 |
| JP | H1038336 | * | 2/1998 |
| SE | 467 790 | B | 9/1992 |
| SE | 467 791 | B | 9/1992 |
| WO | 98/44237 | A | 10/1998 |

* cited by examiner

VENTILATION SYSTEM FOR TUNNEL SECTION OR COVERED ROAD

BACKGROUND OF THE INVENTION

Field of the Invention

The present invention relates to a ventilation system for a tunnel section or a covered road.

Description of the Related Art

Increasing traffic congestion is constantly putting more pressure on the environment from polluting substances released from vehicles.

Vehicles, because of their use of fossil fuels, produce pollutants such as nitrogen oxides and also soot particles. In addition, traffic also produces particulates from products released through wear of the brakes and tyres of vehicles.

There are statutory regulations which provide standards for the maximum permitted exposure of the environment to the abovementioned pollutants caused by traffic, so that environmental pollution can be limited to some extent.

The release of pollutants is at its peak particularly during rush hours (peak loads of the section) when a very large number of vehicles are using the road.

A problem can occur at the mouths of tunnels and covered road sections, where the pollutants can accumulate inside the tunnel because of the reduced discharge to the environment, and such pollutants can be present in high concentrations at the mouths. There are ventilation systems which create a constant air flow in the tunnel in order to freshen the air and discharge the pollutants present in the tunnel to the environment at the entrance and/or exit or at an air outlet point.

An outflow of polluted air can then occur at the entrances and exits of the tunnel or at the air outlet point, so that the abovementioned standards can be seriously exceeded, in particular during peak loads of the tunnel.

BRIEF SUMMARY OF THE INVENTION

It is an object of the present invention to provide a ventilation system for a tunnel which prevents the occurrence of peak loads of pollutants.

This object is achieved by a ventilation system of the abovementioned type for a tunnel or covered road section, in which the tunnel comprises a first tunnel tube or carriageway with a first entrance and a first exit for traffic through the first tunnel tube, and the ventilation system is equipped for:

the production of a blind flow or recirculation flow of air inside the at least first tunnel tube during use, and the controlled discharge of air from the blind flow or recirculation flow at the entrance and/or exit of the at least first tunnel tube.

The ventilation system according to the present invention advantageously by means of the blind flow or recirculation flow ensures that the outflow of pollutants occurs in a controlled manner, so that the exposure and/or load at the ends of the tunnel tube(s) remains below the standard also during peak load of the tunnel.

BRIEF DESCRIPTION OF THE DRAWINGS

The invention will be explained in greater detail below with reference to a number of drawings, in which exemplary embodiments are illustrated. They are intended only for illustrative purposes and not to limit the idea of the invention which is defined by the claims.

DETAILED DESCRIPTION OF THE PREFERRED EMBODIMENTS

Figure 1:
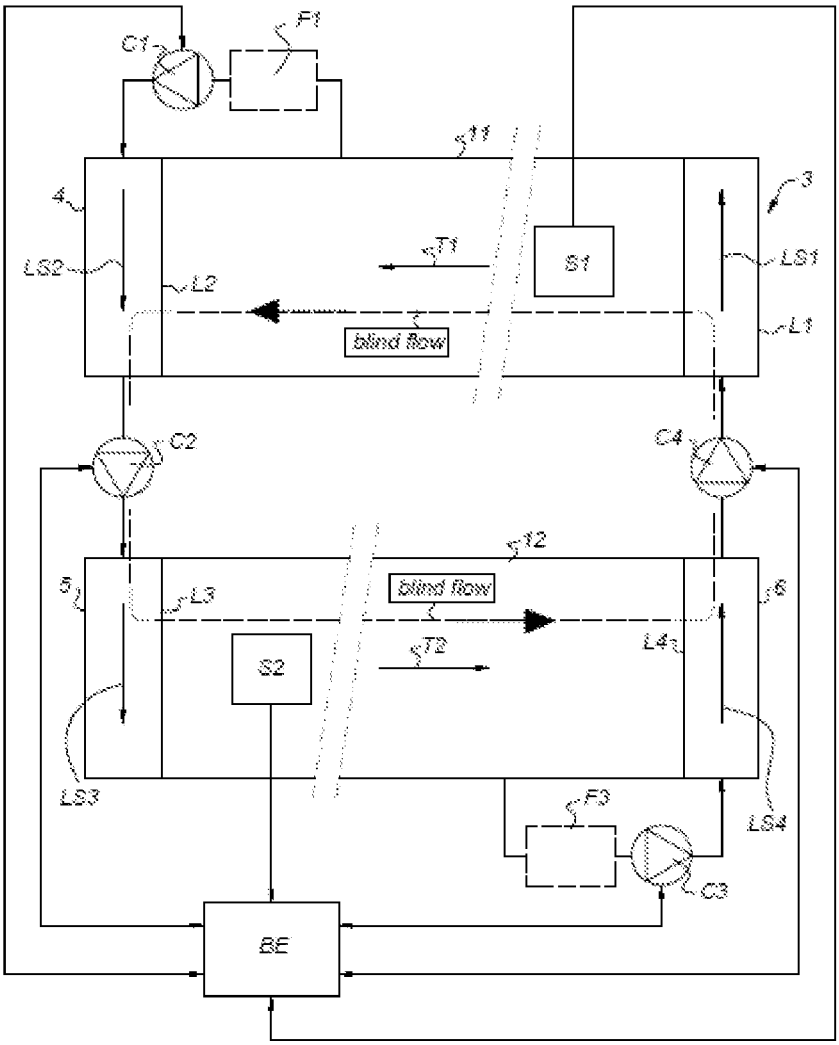
FIG. 1 shows diagrammatically a first embodiment of a ventilation system according to the invention.

FIG. 1 shows diagrammatically a first embodiment of a ventilation system according to the invention.

A ventilation system 1 according to the invention is installed on a tunnel or covered road section 2. The tunnel 2 comprises a first tunnel tube 11 and a second tunnel tube 12.

The first tunnel tube 11 is provided with a first entrance 3 on one side and a first exit 4 on the other side. The direction of movement of the traffic through the first tunnel tube 11 is indicated by the arrow T1.

The second tunnel tube 12 is provided with a second entrance 5 on one side and a second exit 6 on the other side. The direction of movement of the traffic through the second tunnel tube 12 is indicated by the arrow T2.

The ventilation system 1 comprises a first air barrier L1, a second air barrier L2, a third air barrier L3, and a fourth air barrier L4.

An air barrier L1, L2, L3, L4 serves to form a barrier against pollutant particles which are discharged, or tend to be discharged, from the tunnel with the traffic passing through the tunnel. Examples of an air barrier are an air curtain, or a water curtain. It is also possible to use an adaptation of one end of the tunnel by a bend in the end or an adaptation at the end of the tunnel which influences an air flow at the position of the end of the tunnel.

In one embodiment of the invention, air curtain devices are used as the air barrier. The ventilation system 1 furthermore comprises a first air pump C1, a second air pump C2, a third air pump C3, and a fourth air pump C4.

The first air curtain device L1 is placed at the first entrance 3 of the first tunnel tube 11 in order to create a first air curtain or controlled air flow, indicated by the arrow LS1, during use.

The second air curtain device L2 is placed at the first exit 4 of the first tunnel tube 11 in order to create a second air curtain or controlled air flow, indicated by the arrow LS2, during use.

The third air curtain device L3 is placed at the second entrance 5 of the second tunnel tube 12 in order to create a third air curtain or controlled air flow, indicated by the arrow LS3, during use.

The fourth air curtain device L4 is placed at the second exit 6 of the second tunnel tube 12 in order to create a fourth air curtain or controlled air flow, indicated by the arrow LS4, during use.

The direction of the arrow LS1, LS2, LS3, LS4 of the first, second, third and fourth air curtain respectively indicates the direction of flow of the air flow in the respective air curtain.

At the first exit 4 of the first tunnel tube 11, the second air curtain LS2 is maintained during operation by the first air pump C1. The first air pump C1 takes in air at a location inside the first tunnel tube 11 and conveys said air to the second air curtain device L2. A first filter F1 may possibly be accommodated in the supply line of the first air pump in order to filter the air which has been taken in.

A discharge line of the second air curtain device L2 is connected to the second air pump C2, for the purpose of extracting air at the position of the discharge line of the second air curtain device L2. The second air pump C2 is connected by means of an outlet to a supply line of the third air curtain device L3, for the purpose of supplying air to the third air curtain device L3 in order to maintain the third air curtain LS3.

At the second exit 6 of the second tunnel tube 12, the fourth air curtain LS4 is maintained during operation by the third air pump C3. The third air pump C3 takes in air at a location inside the second tunnel tube 12 and conveys said air to the fourth air curtain device L4. A third filter F3 may possibly be accommodated in the supply line of the third air pump in order to filter the air which has been taken in.

A discharge line of the fourth air curtain device L4 is connected to the fourth air pump C4, for the purpose of extracting air at the position of the discharge line of the fourth air curtain device L4. The fourth air pump C4 is connected by means of an outlet to a supply line of the first air curtain device L1, for the purpose of supplying air to the first air curtain device L1 in order to maintain the first air curtain LS1.

The ventilation system 1 furthermore comprises a control unit BE and one or more sensors S1, S2, which are placed in one or both of the tunnel tubes 11, 12.

The control unit BE is connected to the first, second, third and fourth air pump C1, C2, C3, C4 in order to control said air pumps. The control unit is furthermore connected to one or more sensors S1, S2 in the tunnel 2. The one or more sensors S can be placed near or on one of the first, second, third and/or fourth air curtain devices L1, L2, L3, L4, or at a suitable location in the first and/or second tunnel tube 11, 12. The one or more sensors S1, S2 are equipped for measuring traffic intensity, or more particularly concentrations of pollutants.

The aim of the ventilation system 1 is to ensure that effectively no pollutants are released at the ends 3, 4, 5, 6 of the first and second tunnel tubes 11, 12, or that only a maximum quantity of pollutants which does not exceed the standards set (per unit of time) can be released at the ends of the tunnels.

In order to achieve this, the ventilation system according to the invention is equipped to maintain a blind flow or recirculation flow inside the tunnel tubes 11, 12 in the following manner. As is known in the art, by adjusting the strength of the individual air barriers to the traffic flow and the entrained air flows caused by the traffic flow in each of the tunnel tubes, a storage space for pollutants in the tunnel tubes may be created in this way, and a blind flow is created. The blind flow is maintained by extracting flowing air at one air barrier at one end of the tunnel tube(s) and by reusing it at another barrier at another end as a feed of the air flow of that air barrier.

The first, second, third and fourth air curtain devices L1, L2, L3, L4 during use create the first, second, third and fourth air curtain respectively which serve as barriers for the air present in the first and second tunnel tubes 11, 12 in order to ensure that effectively substantially no pollutant in the air leaves the tunnel.

At the exit side of each tunnel tube 11, 12, the pollutant will accumulate because of the entrained flow T1, T2 created by the traffic.

By means of the ventilation system according to the invention, a blind flow or recirculation flow is, however, created, so that the polluted air (with the pollutants) is kept substantially inside the tunnel tubes.

By adjusting the strength of the individual air curtains by means of the control unit BE to the traffic flow (which can be determined, for example, by means of sensors (not shown) in the road surface of each tunnel tube) and the entrained air flows caused by the traffic flow in each of the tunnel tubes, it is possible in this way to obtain a storage space for pollutants in the tunnel tubes. A blind flow is also created in this way.

By adjusting the strength of the air curtains (i.e. the air flow velocity of LS1, LS2, LS3, LS4), it is possible to obtain an effective barrier against inflow of entrained outside air and outflow of air out of the tunnel tube 11, 12, and an accumulation of pollutants can occur in the tunnel tube 11, 12.

In addition, the ventilation system can be provided in such a way that by way of the air output of one or more of the air pumps C1, C2, C3, C4 the air discharge at one or more of the air curtains is regulated in such a way that the blind flow is adapted and a controlled outflow of polluted air, or accumulated polluted air, out of the tunnel tube 11, 12 occurs. This means that the ventilation system can ensure that the standard for pollutants at the position of the ends 3, 4 of the tunnel is not exceeded. In this way, it is possible to use the tunnel as a buffer for pollutants and to allow the release of these pollutants delayed in time (for example, outside a period with peak load of the tunnel).

The control unit BE is equipped for receiving from each of the one or more sensors S1, S2 signals which are related to the concentrations of pollutants. On the basis of the concentrations measured by the one or more sensors S1, S2, the control unit BE is able to set the air output of the air pumps C1, C2, C3, C4, so that the strength of the respective corresponding air curtain can be set.

Of course, traffic moving through the tunnel tube 11, 12 will pass through the air curtains, so that the shut-off is not complete, but the strength of the air curtains can be set in such a way that the outflow of polluted air out of the tunnel tube 11, 12 is greatly reduced compared with the situation in which there are no air curtains at the ends 3, 4, 5, 6 of the tunnel.

In addition, the ventilation system 1 according to the invention can provide for air which is as a blind flow or recirculation flow to be conveyed through the first and/or second filter F1, F2 in order to remove pollutants from the air. This ensures that the concentrations of pollutants in the tunnel tube 11, 12 can likewise be controlled.

Figure 2:
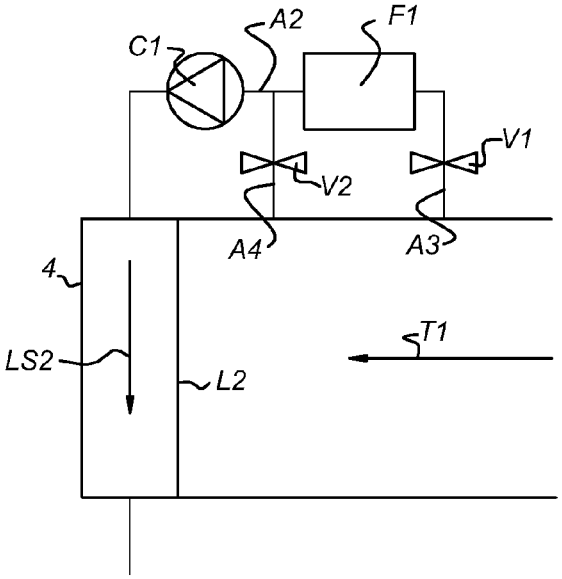
FIG. 2 shows diagrammatically a view of a detail of the ventilation system of FIG. 1 in a further embodiment.

FIG. 2 shows diagrammatically a view of a detail of the ventilation system of FIG. 1 in a further embodiment.

In a further embodiment, the ventilation system can use a control system which is regulated by valves for the filter used in the suction line of the second and/or fourth air pump C2, C4. FIG. 2 shows the situation around the second air pump C2. The suction line L2 comprises a first suction branch A1 in which a first air filter F1 is accommodated, and a second suction branch A2. Both suction branches A1, A2 are in communication with the interior of the first tunnel tube 11. The first and second suction branches are provided with a first and second control valve V1, V2 respectively, which under control of the control unit BE can adjust the output through each of the suction branches A1, A2.

It will be clear to the person skilled in the art that such a device can also be constructed on the suction line of the fourth air pump C4, so that no further explanation as regards the fourth air pump is given here.

Figure 3:
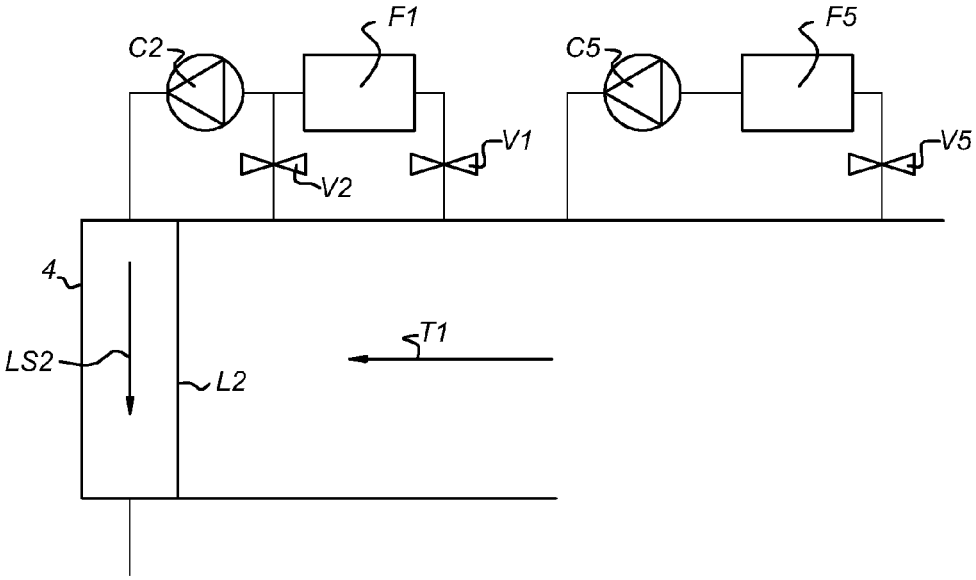
FIG. 3 shows diagrammatically a view of a detail of the ventilation system of FIG. 1 in yet a further embodiment.

FIG. 3 shows diagrammatically a view of a detail of the ventilation system of FIG. 1 in yet a further embodiment.

In yet a further embodiment, an internal filter system can be placed on one or both tunnel tubes 11, 12 in order to extract air inside the respective tunnel tube 11, 12, and to filter said air and pump it back into the tunnel tube. This has the advantage that the accumulation of pollutants inside the tunnel tube 11 can be controlled. As an example, an internal filter system F5 is shown on the first tunnel tube 11. A fifth air pump C5 is connected by way of a supply line and by way of a discharge line to the interior of the tunnel tube 11. By way of a control valve V5 and a filter F5, during use the fifth air pump C5 takes in air out of the tunnel tube 11. After passing through the filter F5, the air has been filtered. The air pump C5 pumps the filtered air back to the interior of the tunnel tube 11.

It will be clear to the person skilled in the art that such a device can also be constructed on the second tunnel tube 12, so that no further explanation as regards the second tunnel tube 12 is given here.

The invention can also be used when a single tunnel, or tunnel tube, is being used for two-way traffic.

Figure 4:
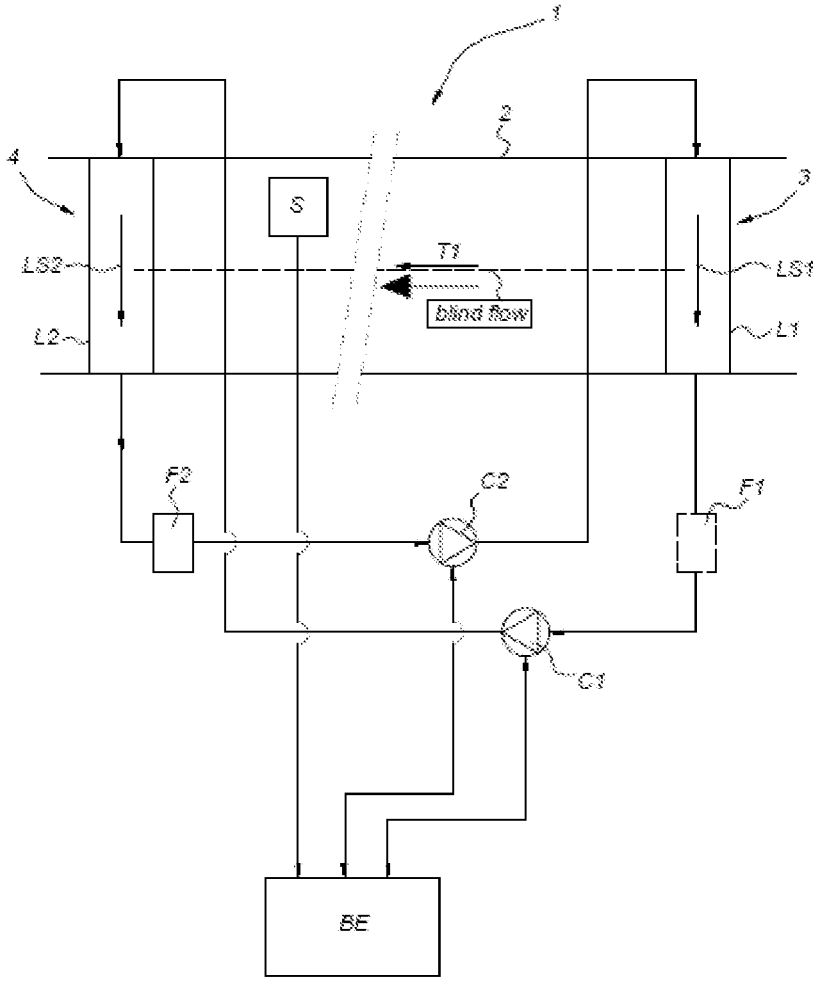
FIG. 4 shows diagrammatically a second embodiment of a ventilation system according to the invention.

FIG. 4 shows diagrammatically a second embodiment of a ventilation system according to the invention. The same reference numerals as those in preceding figures refer to identical elements.

A ventilation system 1 according to the invention is installed on a tunnel or covered road section 2. The tunnel 2 comprises a first tunnel tube 11 or a first carriageway which is provided with a first entrance 3 on one side and a first exit 4 on the other side.

The ventilation system 1 comprises a first air pump C1, a second air pump C2, a first air curtain device L1, a second air curtain device L2, and at least a first filter F1.

The first air curtain device L1 is placed at the first entrance 3 of the tunnel tube 11 in order to create a first air curtain or controlled air flow, indicated by the arrow LS1, during use.

The second air curtain device L2 is placed at the first exit 4 of the tunnel tube 11 in order to create a second air curtain or controlled air flow, indicated by the arrow LS2, during use.

The direction of the arrow LS1, LS2 of the first and second air curtain respectively indicates the direction of flow of the air flow in the respective air curtain.

A discharge line of the first air curtain device L1 is connected to the first air pump C1, for the purpose of extracting air at the position of the discharge line of the first air curtain device L1. The at least first filter F1 is accommodated in a supply line of the first air pump C1, in order to filter the air which has been taken in.

Furthermore, a discharge line of the second air curtain device L2 is connected to the second air pump C2, for the purpose of extracting air at the position of the discharge line of the second air curtain device L2. The second air pump C2 is connected by means of an outlet to a supply line of the first air curtain device L1, for the purpose of supplying air to the first air curtain device L1 in order to maintain the first air curtain LS1.

Furthermore, the ventilation system 1 comprises a control unit BE and one or more sensors S.

The control unit BE is connected to the first and second air pump C1, C2, in order to control the first and second air pumps. The control unit is furthermore connected to one or more sensors S1, S2 in the tunnel 2. The one or more sensors S can be placed near or on the first curtain device L1 and/or second air curtain device L2, or at a suitable location in the tunnel tube 11. The one or more sensors S are equipped for measuring traffic intensity, or more particularly concentrations of pollutants.

The aim of the ventilation system 1 is to ensure that effectively no pollutants are released at the ends 3, 4 of the tunnel, or that only a maximum quantity of pollutants which does not exceed the standards set (per unit of time) can be released at the ends 3, 4 of the tunnel.

In order to achieve this, the ventilation system according to the invention is equipped to maintain a blind flow or recirculation flow inside the tunnel tube 11 in the following manner.

The first air curtain device L1 and second air curtain device L2 during use create the first and second air curtain, which serve as barriers for the air present in the tunnel tube 11. The blind flow can be maintained by extracting the flowing air LS1, LS2 from the air curtain at the respective discharge line at each of the two air curtain devices L1, L2, and reusing it at the other of the two air curtain devices L1, L2 in order to feed the air flow of that air curtain. By adjusting the strength of the air curtains (i.e. the air flow velocity of LS1, LS2), it is possible to obtain an effective barrier against outflow of air out of the tunnel tube 11, and an accumulation of pollutants can occur in the tunnel tube 11.

In addition, the ventilation system can be provided in such a way that by way of the air output of one or both air pumps C1, C2 the air discharge at one or both air curtains is regulated in such a way that the blind flow is adapted and a controlled outflow of (accumulated) polluted air out of the tunnel tube 11 occurs. For the regulation of the air output through an air pump, it is also possible to use regulating valves which are controlled by the control unit. This means that the ventilation system can ensure that the standard for pollutants at the position of the ends 3, 4 of the tunnel are not exceeded. In this way, it is possible to use the tunnel as a buffer for pollutants and to allow the release of these pollutants delayed in time (for example, outside a period with peak load of the tunnel).

The control unit BE is equipped for receiving from each of the one or more sensors S signals which are related to the concentrations of pollutants. On the basis of the concentrations measured by the one or more sensors S, the control unit BE is able to set the air output of the first and/or second air pump C1, C2 respectively, so that the strength of the first and second air curtain respectively can be set. Account can be taken here of the net entrained flow of air in the tunnel as a result of the traffic intensity and the predominant direction of movement of the traffic in the tunnel.

Figure 5:
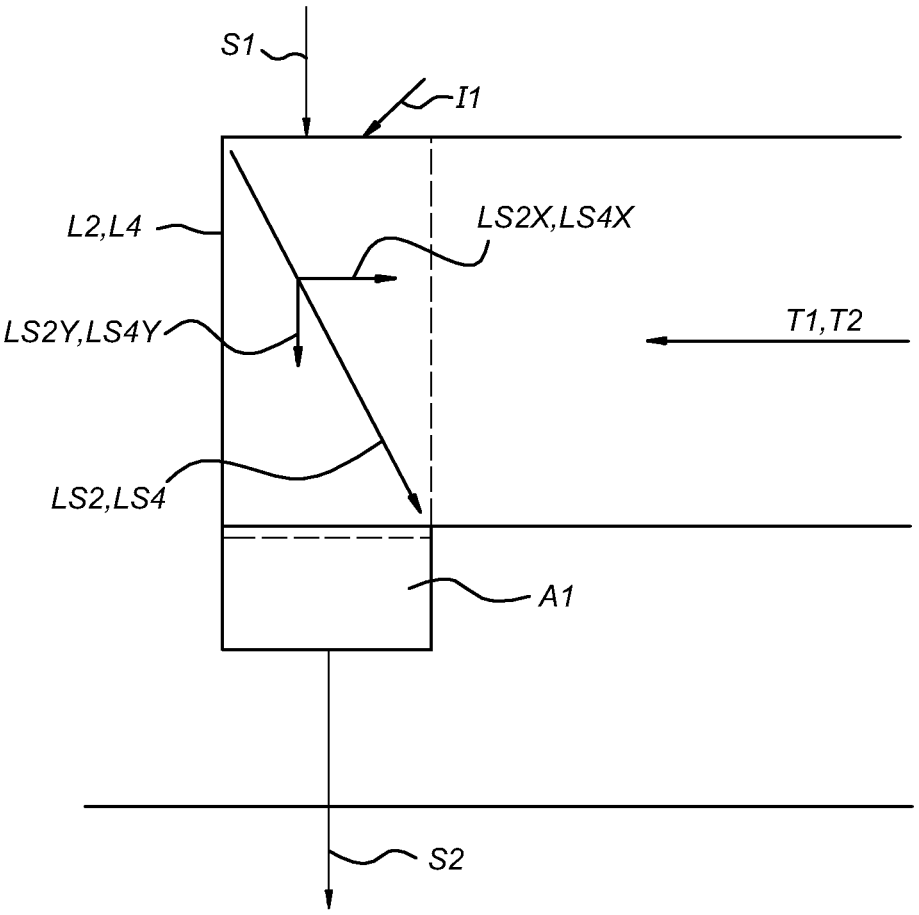
FIG. 5 shows a view of a detail of a part of the ventilation system according to the invention.

FIG. 5 shows a view of a detail of a part of the ventilation system according to a further embodiment of the invention.

It is found to be advantageous to direct the air flow of the air curtains obliquely inwards into the tunnel tube at least at the exit of a tunnel tube. This creates a flow component of the air flow which is directed in the opposite direction to the direction of movement of the traffic and the entrained flow in the tunnel. The barrier effect of the air flow at the tunnel opening is improved in this way.

FIG. 5 shows diagrammatically the second air curtain device L2 at the first exit 4 of the first tunnel tube 11. The air flow LS2 is placed at an oblique angle relative to the tunnel walls, so that a transverse flow component LS2*y* and a parallel flow component LS2*x* are formed. The parallel flow component LS2*x* of the air flow LS2 blown in by the air pump C1 has a direction which is substantially opposite to the direction of travel of traffic T1 and entrained flow in the tunnel tube 11.

It will be clear to the person skilled in the art that such a device can also be constructed at the second exit 6 of the second tunnel tube 12, so that at the position of said exit 6 a parallel flow component LS4$x$ of the air flow LS4 blown in by the air pump C3 has a direction which is substantially opposite to the direction of travel of traffic T2 and the entrained flow in the tunnel tube 11.

At the first or second entrance 3, 5 of the first and second tunnel tube 11, 12 respectively, it is also possible to form a parallel flow component of LS1, LS3 respectively which flows in the same direction as that of the direction of movement of the traffic T1, T2, but in the light of what has been stated above that will now be clear to the person skilled in the art, so that no further explanation as regards the parallel flow component at the entrance(s) of the tunnel tube(s) will be given here.

It is pointed out that in addition to or instead of sensors which measure concentrations of pollutants (or a measured variable linked to them), sensors S, S1, S2 which determine, for example, the traffic intensity can also be used, in which case the traffic intensity or a derivative of traffic intensity is used as the criterion for the control of accumulation of substances in the tunnel.

Other alternatives and equivalent embodiments of the present invention are conceivable within the idea of the invention, as will be clear to the person skilled in the art. The idea of the invention is limited only by the appended claims.

The invention claimed is:

1. A traffic tunnel ventilation system comprising:

a recirculation air flow system configured to be disposed within a traffic tunnel or a covered road section in which road traffic travels, the tunnel or covered road section having at least one tunnel tube with a first entrance and a first exit for the road traffic to pass through the at least one tunnel tube, the recirculation air flow system comprising a first air curtain at the first entrance, a second air curtain at the first exit, an entrained airflow from the first entrance to the first exit in the at least one tunnel tube in the direction of movement of the traffic, and a supply line flow from one or more of the tunnel tube and the first air curtain at the first entrance to the second air curtain at the first exit;

air pumps to control flow through the recirculation air flow system such that air flows from the first air curtain through the at least at least one tunnel tube to the second air curtain and through the supply line to the second air curtain;

at least one air filter for pollutants in a suction line of one of the air pumps filtering said pollutants from the recirculation air flow system;

a control unit connected to each of the air pumps and controlling each of the air pumps; and one or more sensors that sense a concentration of pollutants through the tunnel and provide signals indicative of the sensed concentration of pollutants to the control unit, wherein the first air curtain and the second air curtain comprise an air flow transverse to a direction of movement of the traffic in the at least one tube tunnel to form a barrier against the air flow in the recirculation air flow system containing particles from leaving the at least one tube tunnel, and wherein the control unit controls the air pumps to control the strength of the second air curtain to controllably discharge at least a portion of the entrained air flow based on the sensed concentration of pollutants through the tunnel.

2. The traffic tunnel ventilation system according to claim 1, wherein the at least one tunnel tube includes a first tunnel tube having the first entrance and the first exit, and a second tunnel tube with a second entrance and a second exit, the ventilation system further comprises a first air pump;

a second air pump;

a third air pump;

a fourth air pump;

a first air curtain device;

a second air curtain device;

a third air curtain device; and a fourth air curtain device, the first air curtain device is disposed at the first entrance of the first tunnel tube in order to create a first air curtain or controlled air flow during use, the second air curtain device is disposed at the first exit of the first tunnel tube in order to create a second air curtain or controlled air flow during use, the third air curtain device is disposed at the second entrance of the second tunnel tube in order to create a third air curtain or controlled air flow during use, the fourth air curtain device is disposed at the second exit of the second tunnel tube in order to create a fourth air curtain or controlled air flow during use, the supply line is a second air curtain supply line of the second air curtain device, the first air pump being connected to the second air curtain supply line of the second air curtain device to supply air to the second air curtain device in order to maintain the second air curtain, the second air pump is connected to a discharge line of the second air curtain device and extracts air at the position of the discharge line of the second air curtain device and is connected to a third air curtain supply line of the third air curtain device by a first additional connection and supplies air to the third air curtain device in order to maintain the third air curtain, the third air pump is connected to a fourth air curtain supply line of the fourth air curtain device and supplies air to the fourth air curtain device in order to maintain the fourth air curtain, the fourth air pump is connected to a discharge line of the fourth air curtain device and extracts air at the position of the discharge line of the fourth air curtain device and is connected to a first air curtain supply line of the first air curtain device by a second additional connection and supplies air to the first air curtain device in order to maintain the first air curtain, the control unit controls at least the first air pump and the third air pump to control the strength of the second air curtain and the fourth air curtain to controllably discharge at least a portion of the entrained air flow in the first and second tunnel tubes of the tunnel.

3. The traffic tunnel ventilation system according to claim 2, wherein the control unit is connected to the one or more sensors in the tunnel, the one or more sensors measuring a measured variable related to traffic intensity, and the control unit receives the signals from the one or more sensors, and establishes in relation to said signals a set air output of the air flow of the respective air pumps.

4. The traffic tunnel ventilation system according to claim 3, wherein the sensors measure signals related to the concentration of pollutants.

5. The traffic tunnel ventilation system according to claim 4, wherein the sensors are placed at least at either the first air curtain or the second air curtain, or inside the at least one tunnel tube.

6. The traffic tunnel ventilation system according to claim 2, further comprising a second filter for pollutants, which is accommodated in a suction line of the second air pump and filters the air taken in during use.

7. The traffic tunnel ventilation system according to claim 6, further comprising a third filter for pollutants, which is accommodated in a suction line of the third air pump and filters the air taken in during use.

8. The traffic tunnel ventilation system according to claim 2, further comprising a fifth air pump connected to the interior of the at least one tunnel tube by a supply line and a discharge line, a filter for pollutants being disposed in the supply line of the fifth air pump.

9. The traffic tunnel ventilation system according to claim 8, further comprising a control valve disposed in the supply line, the control valve controlling an air output by the fifth air pump.

10. The traffic tunnel ventilation system according to claim 2, wherein the at least one air filter filters pollutants selected from particulate and/or nitrogen oxide and/or carbon monoxide and/or hydrocarbons out of the air taken in.

11. The traffic tunnel ventilation system according to claim 1, further comprising:

a first air pump; and a second air pump, wherein a first one of the air curtains comprises a first air curtain device, the first air curtain device creating a first air curtain or controlled air flow during use, a second one of the air curtains comprises a second air curtain device, the second air curtain device creating a second air curtain or controlled air flow during use, the first air pump is connected to a discharge line of the first air curtain device, extracts air at the position of the discharge line of the first air curtain device, and is connected to a second air curtain supply line of the second air curtain device by a first additional connection and supplies air to the second air curtain device, the second air pump is connected to a discharge line of the second air curtain device, extracts air at the position of the discharge line of the second air curtain device, and is connected to a first air curtain supply line of the first air curtain device by a second additional connection and supplies air to the first air curtain device, and the ventilation system produces the air flow in the at least one tunnel tube from the entrained air flow by controlling an adjustable air output of the air flow of the air curtains created by the first and second air pumps, respectively.

12. The traffic tunnel ventilation system according to claim 11, further comprising:

wherein the control unit is connected to the one or more sensors in the tunnel, the one or more sensors measuring a measured variable related to traffic intensity, and the control unit receives signals from the one or more sensors, and establishes in relation to said signals a set air flow output of the respective air pumps.

13. The traffic tunnel ventilation system according to claim 12, wherein the control unit controls an outflow of air out of the tunnel as a function of the concentration of pollutants established by the sensors and/or traffic intensity established by the sensors.

14. The traffic tunnel ventilation system according to claim 13, wherein the control unit controls with a time delay.

15. The traffic tunnel ventilation system according to claim 1, wherein the traffic through the at least one tunnel tube facilitates the entrained air flow through the at least one tunnel tube between the first entrance and the first exit of the at least one tunnel tube.

16. A traffic tunnel with a ventilation system for control of an air flow in the tunnel or covered road section, the tunnel comprising:

at least one tunnel tube with an entrance and an exit for traffic through the at least one tunnel tube; and the system comprising a recirculation air flow system comprising a first air curtain at the entrance, a second air curtain at the exit, an entrained airflow from the entrance to the exit in the at least one tunnel tube in the direction of movement of the traffic, and a supply line from one or more of the tunnel tube and the first air curtain at the entrance to the second air curtain at the exit, air pumps to control flow through the recirculation air flow system such that air flows from the first air curtain through the at least one tunnel tube to the second air curtain and through the supply line to the second air curtain, at least one air filter for pollutants in a suction line of one of the air pumps filtering said pollutants from the recirculation air flow system, a control unit connected to each of the air pumps and controlling each of the air pumps, and one or more sensors that sense a concentration of pollutants through the tunnel and provide signals indicative of the sensed concentration of pollutants to the control unit, wherein the first air curtain and the second air curtain comprise an air flow transverse to a direction of movement of the traffic in the at least one tube tunnel to form a barrier against the air flow in the recirculation air flow system containing particles from leaving the at least one tube tunnel, and wherein the control unit controls the air pumps to control the strength of the second air curtain to controllably discharge at least a portion of the entrained air flow based on the sensed concentration of pollutants through the tunnel.

17. The traffic tunnel according to claim 16, wherein the entrained air flow through the at least one tunnel tube between the entrance and the exit of the at least one tunnel tube is facilitated by the traffic flow through the at least one tunnel tube, and an accumulation of pollutants is created by the entrained air flow from and/or by the traffic in the tunnel tube.

18. The traffic tunnel according to claim 16, wherein the at least one tunnel tube includes a first tunnel tube with the first entrance and the second entrance, and a second tunnel tube with a second entrance and a second exit, the ventilation system further comprises a first air pump;

a second air pump;

a third air pump;

a fourth air pump;

a first air curtain device;

a second air curtain device;

a third air curtain device; and a fourth air curtain device, the first air curtain device is disposed at the first entrance of the first tunnel tube in order to create a first air curtain or controlled air flow during use, the second air curtain device is disposed at the first exit of the first tunnel tube in order to create a second air curtain or controlled air flow during use, the third air curtain device is disposed at the second entrance of the second tunnel tube in order to create a third air curtain or controlled air flow during use, the fourth air curtain device is disposed at the second exit of the second tunnel tube in order to create a fourth air curtain or controlled air flow during use, the supply line is a second air curtain supply line of the second air curtain device, the first air pump being connected to the second air curtain supply line of the second air curtain device to supply air to the second air curtain device in order to maintain the second air curtain, the second air pump is connected to a discharge line of the second air curtain device and extracts air at the position of the discharge line of the second air curtain device and is connected to a supply line of the third air curtain device by a first additional connection and supplies air to the third air curtain device in order to maintain the third air curtain, the third air pump is connected to a third air curtain supply line of the fourth air curtain device and supplies air to the fourth air curtain device in order to maintain the fourth air curtain, the fourth air pump is connected to a discharge line of the fourth air curtain device and extracts air at the position of the discharge line of the fourth air curtain device and is connected to a first air curtain supply line of the first air curtain device by a second additional connection and supplies air to the first air curtain device in order to maintain the first air curtain, and the control unit controls at least the first air pump and the third air pump control the strength of the second air curtain and the fourth air curtain to controllably discharge at least a portion of the entrained air flow in the first and second tunnel tubes of the tunnel.

19. A traffic tunnel ventilation method comprising:

disposing a recirculation air flow system in at least one tunnel tube with ends including an entrance and an exit for traffic to pass through the at least one tunnel tube, the recirculation air flow system including a first air curtain at the entrance, a second air curtain at the exit, an entrained airflow from the entrance to the exit in the at least one tunnel tube in the direction of movement of the traffic, and a supply line flow from one or more of the tunnel tube and the first air curtain at the entrance to the second air curtain at the exit;

controllably discharging air from the recirculation air flow system at at least one of the entrance and the exit of the at least one tunnel tube by a control unit connected to and controlling air pumps to control the strength of the second air curtain to controllably discharge at least a portion of the entrained air flow based on a sensed concentration of pollutants through the tunnel sensed by one or more sensors, the one or more sensors providing signals indicative of the sensed concentration of pollutants to the control unit;

filtering pollutants from the air extracted from one end of the tunnel; and regulating the recirculation air flow system based on a sensed concentration of pollutants through the tunnel.

20. The traffic tunnel ventilation method according to claim 19, wherein the entrained air flow through the at least one tunnel tube is facilitated by the traffic flow through the at least one tunnel tube.

* * * * *